US011156947B2

(12) United States Patent
Yamamoto

(10) Patent No.: US 11,156,947 B2
(45) Date of Patent: Oct. 26, 2021

(54) FIXING DEVICE AND IMAGE FORMING APPARATUS

(71) Applicant: Konica Minolta, Inc., Tokyo (JP)

(72) Inventor: Naoki Yamamoto, Aichi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/860,902

(22) Filed: Apr. 28, 2020

(65) Prior Publication Data

US 2020/0363760 A1 Nov. 19, 2020

(30) Foreign Application Priority Data

May 14, 2019 (JP) ..... JP2019-091549

(51) Int. Cl.
*G03G 15/20* (2006.01)

(52) U.S. Cl.
CPC . *G03G 15/2053* (2013.01); *G03G 2215/2032* (2013.01)

(58) Field of Classification Search
CPC ..... G03G 15/2053; G03G 15/2017; G03G 15/2064; G03G 21/1647; G03G 2215/2038; G03G 15/2032
See application file for complete search history.

(56) References Cited

U.S. PATENT DOCUMENTS 7,512,369 B2 * 3/2009 Ishida ..... G03G 15/2053 399/329
10,698,351 B1 * 6/2020 Himeno ..... G03G 15/2053

FOREIGN PATENT DOCUMENTS

JP 2008-046663 A 2/2008

* cited by examiner

*Primary Examiner* — Arlene Heredia
(74) *Attorney, Agent, or Firm* — Squire Patton Boggs (US) LLP

(57) ABSTRACT

A fixing device includes: an endless fixing belt; a pad unit and a driven roller disposed opposite to an inner peripheral surface of the fixing belt so as to entrain the fixing belt; a pair of first supports located so as to sandwich the fixing belt in a width direction of the fixing belt, the pair of first supports supporting the pad unit by fixing the pad unit; and a pair of second supports located so as to sandwich the pair of first supports in the width direction of the fixing belt, the pair of second supports rotatably journaling the driven roller.

6 Claims, 8 Drawing Sheets

FIXING DEVICE AND IMAGE FORMING APPARATUS

The entire disclosure of Japanese Patent Application No. 2019-091549, filed on May 14, 2019, is incorporated herein by reference in its entirety.

BACKGROUND

Technological Field

The present disclosure relates to a fixing device that fixes a toner image formed on a recording material such as a sheet onto the recording material and an image forming apparatus, such as a copying machine, a printer, and a facsimile, which includes the fixing device in an image forming unit that forms an image using an electrophotographic system regardless of a type such as color and monochrome.

Description of the Related Art

Generally, from the viewpoint of safety and efficiency, a heat fixing system fixing device in which the toner image is fixed onto the recording material on which the toner image is formed by applying heat and pressure to the recording material is used as a fixing device included in an electrophotographic system image forming apparatus. In the heat fixing system fixing device, the recording material on which the toner image is formed is sandwiched between a heating rotating body and a pressure rotating body, thereby fixing the toner image.

Various types of heating rotating bodies are known as the heating rotating body, and a heating rotating body using an endless fixing belt is known from the viewpoint of energy saving. The heating rotating body using the fixing belt is generally formed as a fixing belt unit in which the fixing belt, a pad unit against which the fixing belt is pressed by the pressure rotating body, a driven roller around which the fixing belt is entrained with the pad unit, a heat source that heats the fixing belt, and the like are assembled.

Japanese Laid-Open Patent Publication No. 2008-46663 discloses a fixing device including the heating rotating body having the above configuration and an image forming apparatus including the fixing device.

SUMMARY

In the fixing device including the heating rotating body having this kind of configuration, it is necessary to support the pad unit and the driven roller at positions on both end sides in a width direction of the fixing belt using a support member such as a chassis. In particular, it is inevitable to enlarge a support supporting the driven roller because the support needs to rotatably journal the driven roller.

For this reason, in order to downsize the fixing device and the image forming apparatus including the fixing device, it is necessary to devise some sort of layout such that the pad unit and the support supporting the driven roller do not interfere with each other.

An object of the present disclosure is to further downsize the fixing device using the fixing belt and the image forming apparatus including the fixing device than before.

To achieve at least one of the abovementioned objects, a fixing device reflecting one aspect of the present disclosure has the following configuration. A fixing device reflecting one aspect of the present disclosure fixes a toner image formed on a recording material onto the recording material, and includes a fixing belt, a heat source, a pad unit, a pressure rotating body, a driven roller, a pair of first support, and a pair of second supports. The fixing belt is an endless fixing belt, and the heat source is configured to heat the fixing belt. The pad unit is disposed so as to be opposed to an inner peripheral surface of the fixing belt, and the pressure rotating body is disposed so as to be opposed to an outer peripheral surface of the fixing belt. The pressure rotating body is rotated while the fixing belt is pressed against the pad unit, so that the pressure rotating body forms a nip in which the recording material is conveyed between the outer peripheral surface of the fixing belt and the pressure rotating body while driving the fixing belt to rotate. The driven roller is disposed so as to be opposed to the inner peripheral surface of the fixing belt, so that the fixing belt is entrained around the driven roller and the pad unit, the driven roller being driven to rotate in association with rotation of the fixing belt. The pair of first supports is located so as to sandwich the fixing belt in a width direction of the fixing belt, the pair of first supports supporting the pad unit by fixing the pad unit. The pair of second supports is located so as to sandwich the pair of first supports in the width direction of the fixing belt, the pair of second supports rotatably journaling the driven roller.

To achieve at least one of the abovementioned objects, an image forming apparatus reflecting one aspect of the present disclosure includes the fixing device reflecting one aspect of the present disclosure in order to form an image.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
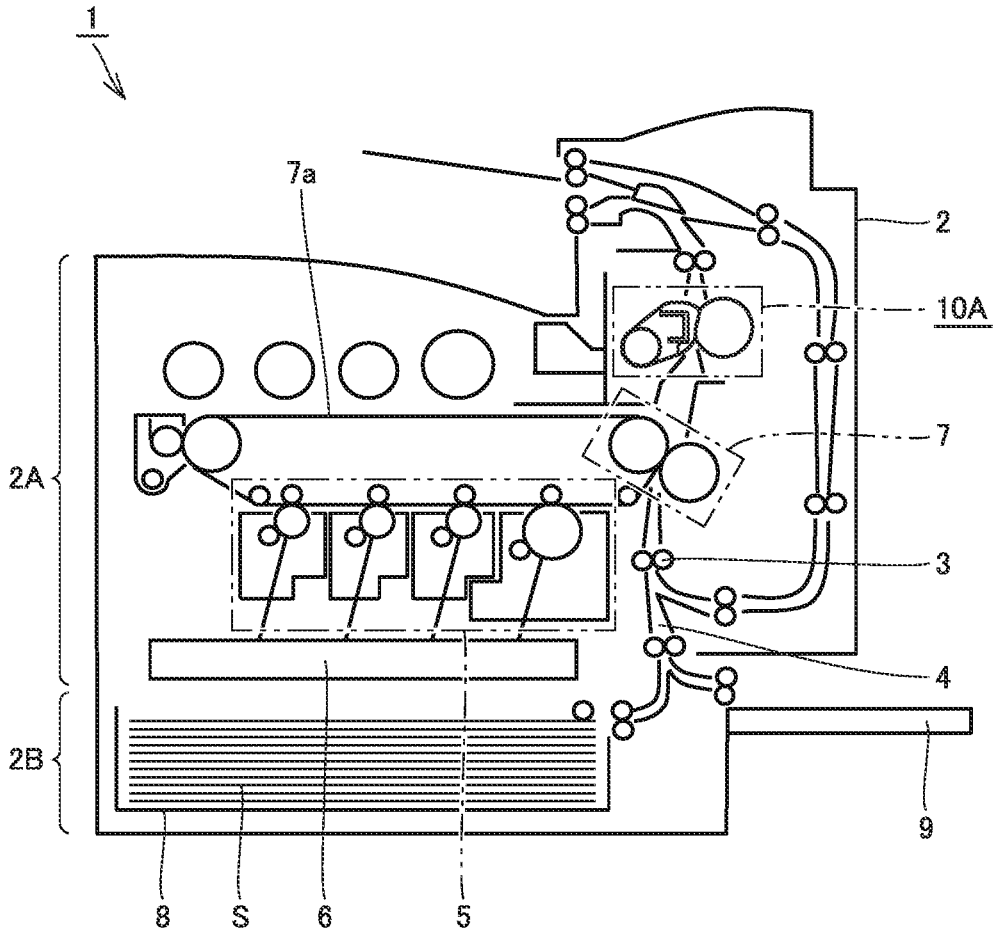
FIG. 1 is a schematic diagram illustrating an image forming apparatus according to a first embodiment.

Hereinafter, one or more embodiments of the present invention will be described with reference to the drawings. However, the scope of the invention is not limited to the disclosed embodiments.

In the following embodiments, a so-called tandem-type color printer adopting an electrophotographic system and a fixing device provided in the tandem-type color printer will be described as an example of an image forming apparatus and a fixing device to which the present invention is applied. In the following embodiments, the same or common components are denoted by the same reference numeral in the drawings, and the description will not be repeated.

First Embodiment

FIG. 1 is a schematic diagram illustrating an image forming apparatus according to a first embodiment. With reference to FIG. 1, a schematic configuration and operation of an image forming apparatus 1 of the first embodiment will be described below.

As illustrated in FIG. 1, image forming apparatus 1 mainly includes an apparatus body 2 and a sheet feeding unit 8. Apparatus body 2 includes an image forming unit 2A that is a part for forming an image on a sheet S as a recording material and a sheet feeder 2B that is a part for supplying sheet S to image forming unit 2A. Sheet feeding unit 8 stores sheet S to be supplied to image forming unit 2A, and is detachably provided in sheet feeder 2B.

In image forming apparatus 1, a plurality of rollers 3 are installed, whereby a conveyance path 4 through which sheet S is conveyed along a predetermined direction is constructed across image forming unit 2A and sheet feeder 2B. As illustrated in FIG. 1, a manual feed tray 9 that supplies sheet S to the image forming unit 2A may separately be provided in apparatus body 2.

For example, image forming unit 2A mainly includes an imaging unit 5 that can form a toner image of each color of yellow (Y), magenta (M), cyan (C), and black (K), an exposure unit 6 that exposes a photoreceptor included in imaging unit 5, an intermediate transfer belt 7*a* entrained around imaging unit 5, and a transfer unit 7 provided on conveyance path 4 and on a running path of intermediate transfer belt 7*a*, and a fixing device 10A of the first embodiment, which will be described later, provided on conveyance path 4 on a downstream side of transfer unit 7.

Imaging unit 5 receives the exposure of light from exposure unit 6, forms a toner image of each color of yellow (Y), magenta (M), cyan (C) and black (K) or a toner image formed of only black (K) on a surface of the photoreceptor, and transfers the toner image to intermediate transfer belt 7*a* (so-called primary transfer). Consequently, a color toner image or a monochrome toner image is formed on intermediate transfer belt 7*a*.

Intermediate transfer belt 7*a* transports the color toner image or the monochrome toner image formed on the surface of intermediate transfer belt 7*a* to transfer unit 7, and is pressed by transfer unit 7 together with sheet S conveyed from sheet feeder 2B to transfer unit 7. Consequently, the color toner image or the monochrome toner image formed on the surface of intermediate transfer belt 7*a* is transferred to sheet S (so-called secondary transfer).

Then, sheet S on which the color toner image or the monochrome toner image is transferred is pressurized and heated by fixing device 10A. Consequently, a color image or a monochrome image is formed on sheet S, and sheet S on which the color image or the monochrome image is formed is discharged from apparatus body 2.

Figure 2:
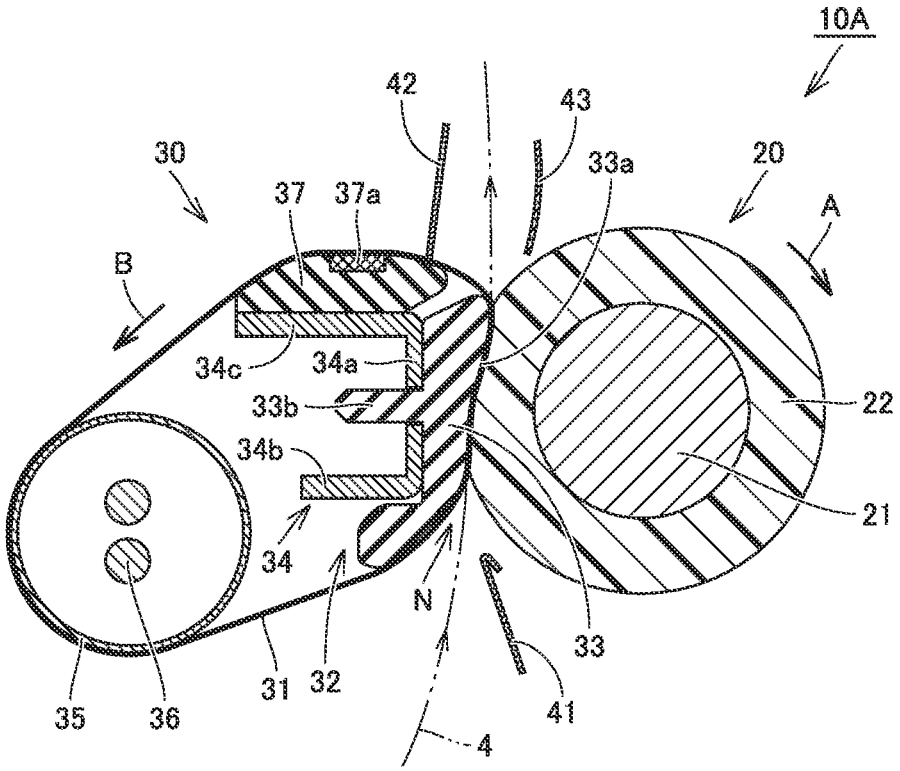
FIG. 2 is a schematic sectional view illustrating a fixing device of the first embodiment.
Figure 3:
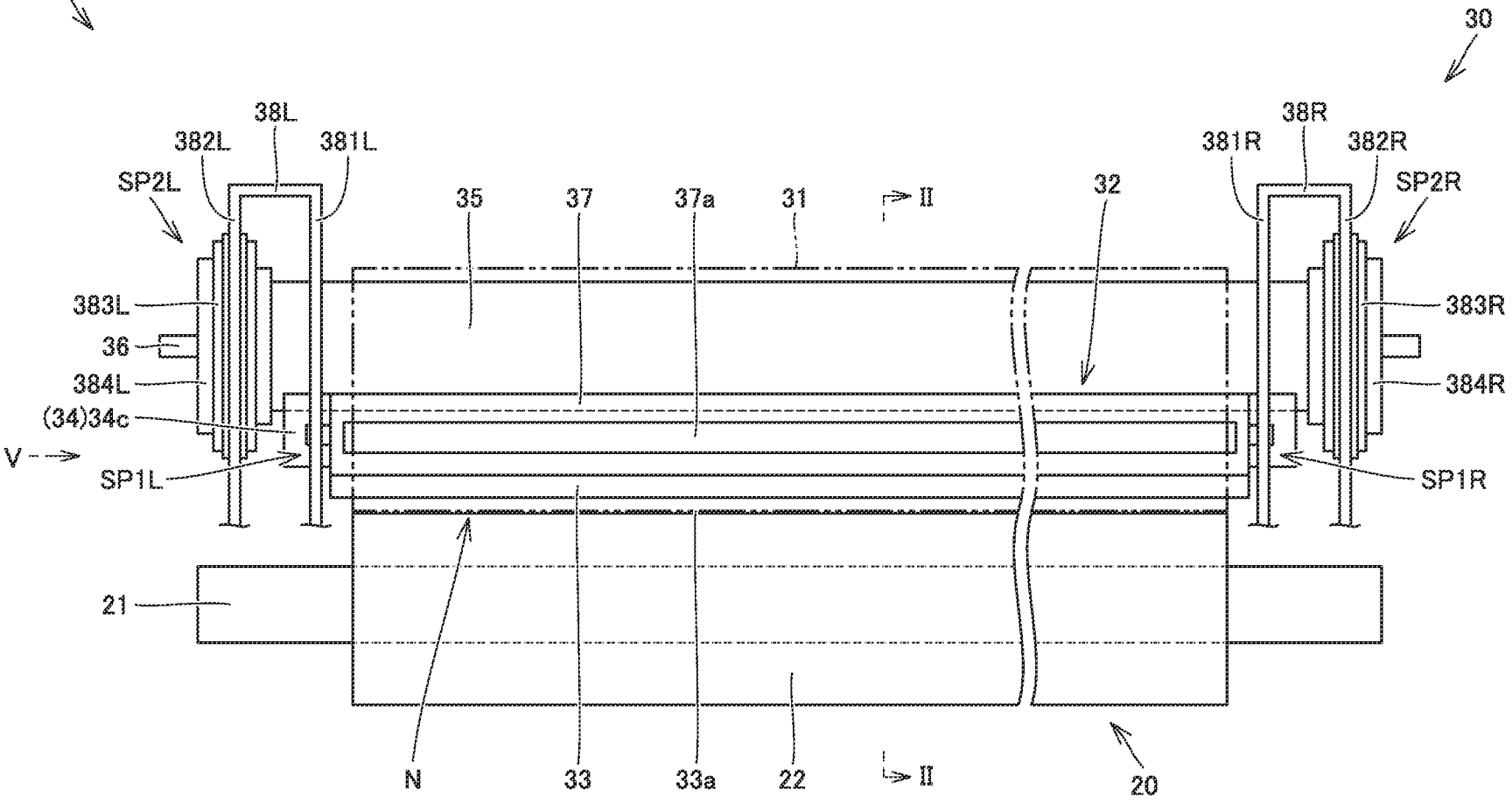
FIG. 3 is a schematic plan view illustrating the fixing device in FIG. 2.

FIG. 2 is a schematic sectional view illustrating the fixing device of the first embodiment, and FIG. 3 is a schematic plan view illustrating the fixing device in FIG. 2. The configuration and operation of fixing device 10A of the first embodiment will be described below with reference to FIGS. 2 and 3. FIG. 2 is a view illustrating a section in a central portion in the width direction of fixing belt 31 (that is, a sectional view taken along line II-II in FIG. 3). In FIG. 3, fixing belt 31 is illustrated by an imaginary line for the purpose of easy understanding.

As illustrated in FIGS. 2 and 3, fixing device 10A mainly includes a pressure roller 20 as the pressure rotating body, a fixing belt unit 30 as the heating rotating body including a fixing belt 31, and various guides 41 to 43 that guides the conveyance of sheet S.

Pressure roller 20 includes a core metal 21 made of metal such as an aluminum alloy, steel, or the like and a rubber elastic layer 22 that is provided to cover core metal 21 and made of silicone rubber, fluorine rubber, or the like. Pressure roller 20 may further include a release layer that is provided to cover elastic layer 22 and is made of a fluorine-based resin or the like.

Core metal 21 may have various shapes such as a solid columnar shape or a cylindrical shape. An outer diameter of core metal 21 is not particularly limited. For example, the outer diameter is greater than or equal to 20 mm and less than or equal to 100 mm. A thickness of elastic layer 22 and a thickness of the release layer are not particularly limited. For example, the thickness of elastic layer 22 is greater than or equal to 1 mm and less than or equal to 20 mm, and the thickness of the release layer is greater than or equal to 5 μm and less than or equal to 100 μm.

Pressure roller 20 is disposed so as to be opposed to an outer peripheral surface of fixing belt 31, and both ends in an axial direction of pressure roller 20 are rotatably journaled by a shaft support (not illustrated). Pressure roller 20 is rotated by a drive source such as a motor (not illustrated). Pressure roller 20 is configured to be elastically biased toward the fixing belt unit 30 side by a biasing member (not illustrated).

In addition to fixing belt 31, fixing belt unit 30 mainly includes a pad unit 32, a heating roller 35 as the driven roller, a heat source 36, an auxiliary pad 37, and a first plate-shaped chassis 38L and a second plate-shaped chassis 38R as the pair of support members. Pad unit 32 has a pad body 33 and a reinforcing member 34.

Fixing belt 31 has an endless shape, and is made of, for example, a plurality of layers in consideration of a heat-resisting property, strength, surface smoothness, and the like. Specifically, fixing belt 31 includes abase material layer made of a polyimide resin, a stainless steel alloy, nickel electroforming, or the like, a rubber elastic layer made of silicone rubber, fluorine rubber, or the like, and a release layer made of a fluorine resin or the like. In the plurality of layers, the base material layer, the elastic layer, and the release layer are located in order from an inside to an outside of fixing belt 31.

A peripheral length of fixing belt 31 is not particularly limited. For example, the outer diameter of fixing belt 31 is greater than or equal to 10 mm and less than or equal to 100 mm. The thickness of the base material layer, the thickness of the elastic layer, and the thickness of the release layer are not particularly limited. For example, the thickness of the base material layer is greater than or equal to 5 μm and less than or equal to 100 μm, the thickness of the elastic layer is greater than or equal to 10 μm and less than or equal to 300 μm, and the thickness of the release layer is greater than or equal to 5 μm and less than or equal to 100 μm.

Pad body 33 is formed of a long plate-shaped member extending along the width direction (that is, the axial direction of pressure roller 20) of fixing belt 31, and disposed in a space inside fixing belt 31. Consequently, pad body 33 faces the inner peripheral surface of fixing belt 31 so as to be opposed to pressure roller 20 with fixing belt 31 interposed therebetween, and pad body 33 includes an opposing surface 33*a* opposed to fixing belt 31.

For example, pad body 33 is formed of a resin member made of a liquid crystal polymer resin, a polyphenylene sulfide resin, or a polyimide resin or a metal member made of an aluminum alloy or steel. Pad body 33 may be formed of a composite component of any one of the above members and a rubber member made of silicone rubber or fluorine rubber.

The surface of pad body 33 may be covered with a sliding contact sheet (not illustrated). For example, a sheet in which the surface of a woven fabric of a glass fiber as the base material is covered with a coating layer made of fluororesin can be used as the sliding contact sheet. When the sliding contact sheet is provided, slidability between fixing belt 31 and pad unit 32 is improved.

Reinforcing member 34 is formed of a long plate-shaped member extending along the width direction of fixing belt 31, and disposed in the space inside fixing belt 31 so as to be located on a side opposite to a side on which pressure roller 20 is located as viewed from pad body 33. Reinforcing member 34 reinforces pad body 33 while supporting pad body 33.

Reinforcing member 34 has a substantially C-shaped section including a flat plate-shaped base 34*a* opposed to pad body 33 and a pair of flat standing walls (the standing wall includes an upstream-side standing wall 34*b* and a downstream-side standing wall 34*c*) provided upright from base 34*a* toward the side opposite to the side where pressure roller 20 is located.

Upstream-side standing wall 34*b* that is one of the pair of standing walls is provided upright from base 34*a* at an upstream position (that is, a lower position in FIG. 2) in a conveyance direction of sheet S, and downstream-side standing wall 34*c* that is the other of the pair of standing walls is provided upright from base 34*a* at a downstream position (that is, an upper position in FIG. 2) in the conveyance direction of sheet S.

For example, reinforcing member 34 is made of a metal member such as an electrogalvanized steel sheet (SECC). Both ends in the width direction of reinforcing member 34 is supported by a pair of support members including a first plate-shaped chassis 38L and a second plate-shaped chassis 38R, thereby fixing reinforcing member 34. A more specific structure for assembling reinforcing member 34 (pad unit 32) in the support member will be described later in detail.

A hook-shaped latching unit (not illustrated) provided around pad body 33 is latched in a periphery of base 34*a* of reinforcing member 34 while a positioning pin 33*b* provided upright from a main surface located on the side opposite to opposing surface 33*a* of pad body 33 is inserted into and fixed to a through-hole provided in base 34*a* of reinforcing member 34, whereby pad body 33 is assembled while lightly held by reinforcing member 34.

Heating roller 35 is formed of a cylindrical member extending along the width direction of fixing belt 31, and disposed in the space inside fixing belt 31 so as to be located on the side opposite to the side on which pressure roller 20 is located as viewed from support unit 32. Consequently, the outer peripheral surface of heating roller 35 faces the inner peripheral surface of fixing belt 31. Heating roller 35 transfers heat generated by heat source 36 to fixing belt 31.

Heating roller 35 is formed of a metal cylindrical member made of an aluminum alloy. The outer diameter of heating roller 35 is not particularly limited. For example, the outer diameter is greater than or equal to 10 mm and less than or equal to 100 mm. Preferably, the inner peripheral surface of heating roller 35 is covered with a black layer in order to efficiently transfer the heat, and the outer peripheral surface of heating roller 35 is covered with a protective layer made of fluororesin or the like.

Both ends in the width direction of heating roller 35 is supported by first plate-shaped chassis 38L and second plate-shaped chassis 38R, whereby heating roller 35 is rotatably journaled by the pair of support members including first plate-shaped chassis 38L and second plate-shaped chassis 38R. A more specific structure for assembling heating roller 35 in the support member will be described later in detail.

Heat source 36 includes a long heater and a short heater, which are a pair of rod-shaped heaters extending along a direction parallel to the width direction of fixing belt 31, and heat source 36 is disposed in a space inside heating roller 35. Heat source 36 heats fixing belt 31 through heating roller 35, and both ends in the axial direction of heat source 36 are held by a holder (not illustrated). For example, each of the long heater and the short heater is formed of a halogen heater.

The long heater has a heat generator in a region corresponding to substantially the whole region in the width direction of fixing belt 31, and the heat generator mainly generates heat to heat fixing belt 31 through heating roller 35 by radiant heat. The axial length of the heat generator corresponds to the width of the sheet having the maximum width in sheets of various sizes supplied to image forming apparatus 1.

The short heater includes a heat generator only in a region corresponding to a central portion in the width direction of fixing belt 31, and the heat generator mainly generates heat to heat fixing belt 31 through heating roller 35 by the radiant heat. The axial length of the heat generator corresponds to the width of the sheet having the minimum width in sheets of various sizes supplied to image forming apparatus 1.

In addition to the halogen heater, an IH (electromagnetic induction heating) type heat source or the like can be used as heat source 36, and heating roller 35 or fixing belt 31 formed of a resistance heating element can be used as the heat source.

Auxiliary pad 37 is formed of a long plate-like member extending along the width direction of fixing belt 31, and is fixed to the outside surface of downstream-side standing wall 34*c* provided on reinforcing member 34 so as to be disposed in the space inside fixing belt 31. Auxiliary pad 37 is a guide that guides fixing belt 31, and applies a lubricant to the inner peripheral surface of fixing belt 31.

More specifically, auxiliary pad 37 is provided at a downstream position of a nip N (to be described later) in the rotation direction of fixing belt 31, and includes a lubricant supply unit 37*a* as an application unit. For example, lubricant supply unit 37*a* is made of felt impregnated with a lubricant such as grease, and the lubricant is supplied to the inner peripheral surface of fixing belt 31 by abutting the inner peripheral surface of fixing belt 31 onto lubricant supply unit 37*a*. Consequently, the slidability between fixing belt 31 and pad unit 32 is improved.

At this point, as described above, pressure roller 20 is configured to be elastically biased toward the fixing belt unit 30 side by the biasing member (not illustrated). For this reason, pressure roller 20 is elastically biased in the direction in which pressure roller 20 approaches fixing belt 31 by the biasing force of the biasing member, whereby fixing belt 31 is pressed against pad unit 32 by pressure roller 20. Consequently, a pressing state in which pad unit 32 is pressed by pressure roller 20 is obtained.

On the other hand, fixing belt 31 is entrained around pad unit 32, heating roller 35, and auxiliary pad 37. Consequently, fixing belt 31 can rotate so as to slide on the main surface (that is, on opposing surface 33*a* of pad body 33) of pad unit 32 on the pressure roller 20 side. Due to this rotation, a portion of fixing belt 31 that is in contact with heating roller 35 is heated by heat source 36. Then, the portion of fixing belt 31 moves to nip N (to be described later), and sheet S supplied to nip N and the toner image formed on sheet S are heated by the portion of fixing belt 31.

That is, in fixing device 10A of the first embodiment, as described above, pressure roller 20 is rotated in a direction of an arrow A in FIG. 2 by a drive source (not illustrated) while pressure roller 20 is biased toward the fixing belt unit 30 side, whereby fixing belt 31 is driven to rotate in a direction of an arrow B in FIG. 2 so as to slide on pad unit 32. At this point, heating roller 35 as the driven roller is also driven and rotated.

Consequently, nip N in which sheet S is conveyed is formed between pressure roller 20 and pad unit 32 (more strictly, between pressure roller 20 and outer peripheral surface of fixing belt 31). In other words, pressure roller 20 and fixing belt unit 30 are disposed so as to sandwich conveyance path 4 such that nip N formed between pressure roller 20 and fixing belt unit 30 is located on conveyance path 4 of sheet S.

An entrance-side guide 41 is provided at a position on conveyance path 4 and at a position on the upstream side of nip N along the conveyance direction of sheet S (that is, a lower position in FIG. 2). Entrance-side guide 41 is a guide that reliably inputs sheet S conveyed on conveyance path 4 to nip N.

A separation guide 42 and an exit-side guide 43 is provided at a position on conveyance path 4 at a position on the downstream side of nip N along the conveyance direction of sheet S (that is, an upper position in FIG. 2). The separation guide 42 is a guide that separates sheet S that is in close contact with fixing belt 31 when sheet S is discharged from nip N from fixing belt 31, and exit-side guide 43 is a guide that reliably returns sheet S separated from fixing belt 31 by separation guide 42 onto conveyance path 4.

With the above configuration, in fixing device 10A of the first embodiment, during the fixing operation (that is, in the pressed state), the toner image formed on sheet S is heated and pressurized in nip N, whereby the toner image is fixed onto sheet S.

Figure 4:
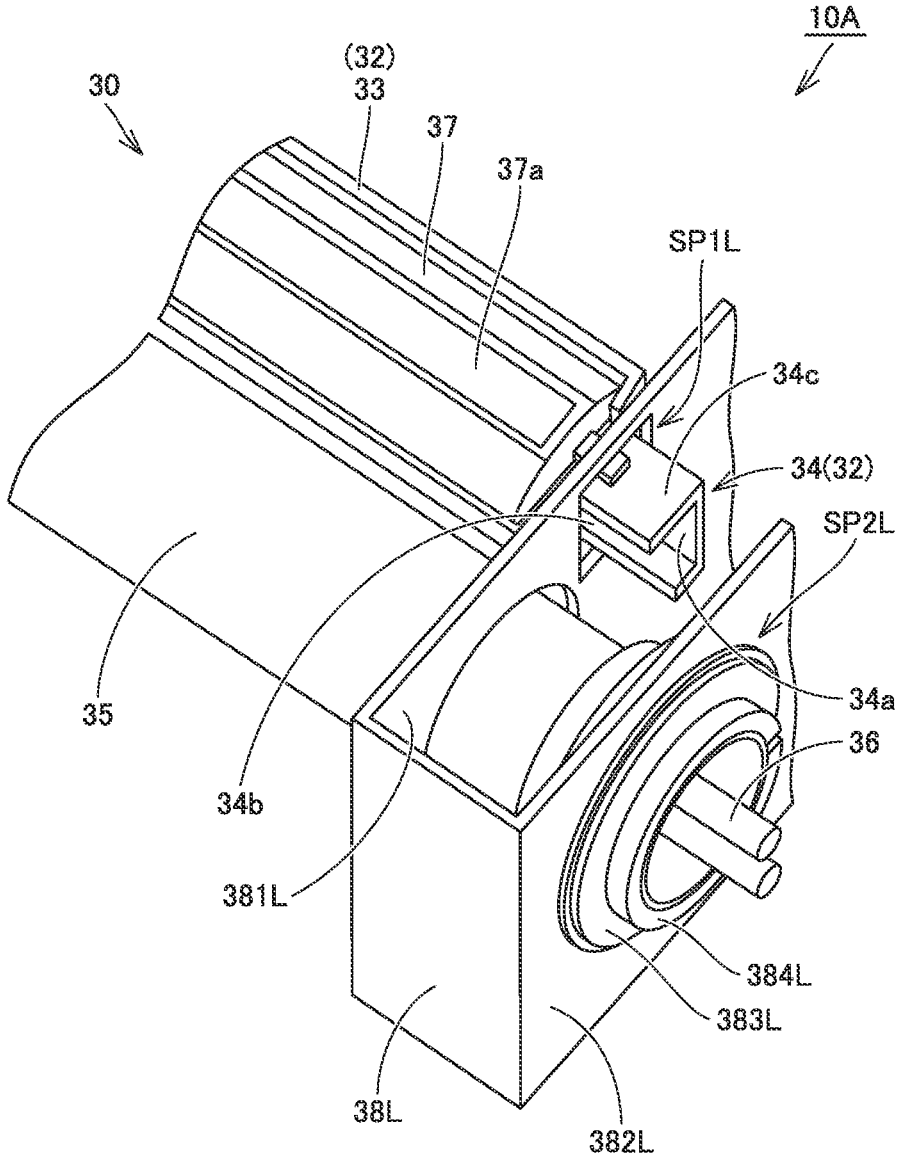
FIG. 4 is a schematic perspective view illustrating a main part of the fixing device in FIG. 2.

FIG. 4 is a schematic perspective view illustrating a main part of the fixing device in FIG. 2. At this point, FIG. 4 illustrates the structure of the end of fixing belt unit 30 on the side where first plate-shaped chassis 38L is located, and fixing belt 31 is omitted in FIG. 4. The structure for assembling pad unit 32 and heating roller 35 in first plate-shaped chassis 38L and second plate-shaped chassis 38R in fixing device 10A of first embodiment will be described below in detail with reference to FIGS. 3 and 4.

As illustrated in FIG. 3, first plate-shaped chassis 38L is formed of a metal member having a bent shape disposed on one side (that is, the left side in FIG. 3) in the width direction of fixing belt 31, and includes a pair of first walls 381L, 382L located to be opposed to each other along the width direction of fixing belt 31. First walls 381L, 382L are disposed in this order from the central portion of fixing device 10A toward the outside. That is, first wall 381L is disposed closer to the fixing belt 31 than first wall 382L is.

Second plate-shaped chassis 38R is formed of a metal member having a bent shape disposed on the other side (that is, the right side in FIG. 3) in the width direction of fixing belt 31, and includes a pair of second walls 381R, 382R located to be opposed to each other along the width direction of fixing belt 31. Second walls 381R, 382R are disposed in this order from the central portion of fixing device 10A toward the outside. That is, second wall 381R is disposed closer to fixing belt 31 than second wall 382R is.

As illustrated in FIG. 3 and particularly in FIG. 4, a first support SP1L fixedly supporting the end (hereinafter, for convenience, the end is referred to as a "left end of pad unit 32") of pad unit 32 on one side (that is, the left side in FIG. 3) in the width direction of fixing belt 31 and a second support SP2L rotatably journaling the end (hereinafter, for convenience, the end is referred to as a "left end of heating roller 35") of heating roller 35 on one side (that is, the left side in FIG. 3) in the width direction of fixing belt 31 are provided in first plate-shaped chassis 38L.

Specifically, as illustrated in FIG. 4, a hole having a substantially rectangular shape in planar view is provided in first wall 381L of first plate-shaped chassis 38L, and the end of reinforcing member 34 is fitted in the hole, whereby the left end of pad unit 32 is assembled in first plate-shaped chassis 38L. That is, the portion in which the hole is provided in first wall 381L of first plate-shaped chassis 38L functions as first support SP1L.

A hole having a substantially circular shape in planar view is provided in first wall 382L of first plate-shaped chassis 38L, and the left end of heating roller 35 is inserted into the hole. At this point, a bearing 383L is previously assembled in the hole provided in first wall 382L, and a substantially cylindrical bush 384L is previously assembled in the left end of heating roller 35. For this reason, bush 384L assembled in heating roller 35 is press-fitted in bearing 383L assembled in first wall 382L, whereby the left end of heating roller 35 is inserted into the hole.

Consequently, the left end of heating roller 35 is rotatably journaled by first plate-shaped chassis 38L with bearing 383L and bush 384L interposed therebetween. That is, the portion in which the hole is provided in first wall 382L of first plate-shaped chassis 38L, bush 384L, and the bearing 383L function as second support SP2L.

On the other hand, although not illustrated in detail, as illustrated in FIG. 3, a hole having a substantially rectangular shape in planar view is provided in second wall 381R of second plate-shaped chassis 38R, and the end of reinforcing member 34 is fitted in the hole, whereby the right end of pad unit 32 is assembled in second plate-shaped chassis 38R. That is, the portion in which the hole is provided in second wall 381R of second plate-shaped chassis 38R functions as a first support SP1R.

A hole having a substantially circular shape in planar view is provided in second wall 382R of second plate-shaped chassis 38R, and the right end of heating roller 35 is inserted into the hole. At this point, a bearing 383R is previously assembled in the hole provided in second wall 382R, and a substantially cylindrical bush 384R is previously assembled in the right end of heating roller 35. For this reason, bush 384R assembled in heating roller 35 is press-fitted in bearing 383R assembled in second wall 382R, whereby the right end of heating roller 35 is inserted into the hole.

Consequently, the right end of heating roller 35 is rotatably journaled by second plate-shaped chassis 38R with bearing 383R and bush 384R interposed therebetween. That is, the portion in which the hole is provided in second wall 382R of second plate-shaped chassis 38R, bush 384R, and bearing 383R function as a second support SP2R.

As described above, the pair of first supports SP1L, SP1R are provided in first plate-shaped chassis 38L and second plate-shaped chassis 38R so as to sandwich fixing belt 31 in the width direction of fixing belt 31, and pad unit 32 is supported by the pair of first supports SP1L, SP1R.

The pair of second supports SP2L, SP2R are provided in first plate-shaped chassis 38L and second plate-shaped chassis 38R so as to sandwich the pair of first supports SP1L, SP1R in the width direction of fixing belt 31, and the heating roller 35 is rotatably journaled by the pair of second supports SP2L, SP2R.

That is, by adopting the above configuration, the pair of first supports SP1L, SP1R supporting pad unit 32 and second supports SP2L, SP2R rotatably journaling heating roller 35 are supported at different positions in the width direction of fixing belt 31, so that pad unit 32 and heating roller 35 can be disposed close to each other while avoiding interference between the portions supporting pad unit 32 and heating roller 35.

Thus, pad unit 32 and the driven roller can be disposed closer to each other by adopting the configuration of the first embodiment, so that fixing device 10A further downsized than before and image forming apparatus 1 including fixing device 10A can be constructed. The circumferential length of fixing belt 31 itself can also be shortened by adopting the above configuration, so that the heat capacity of fixing belt 31 can be decreased to further achieve the energy saving than before.

Figure 5:
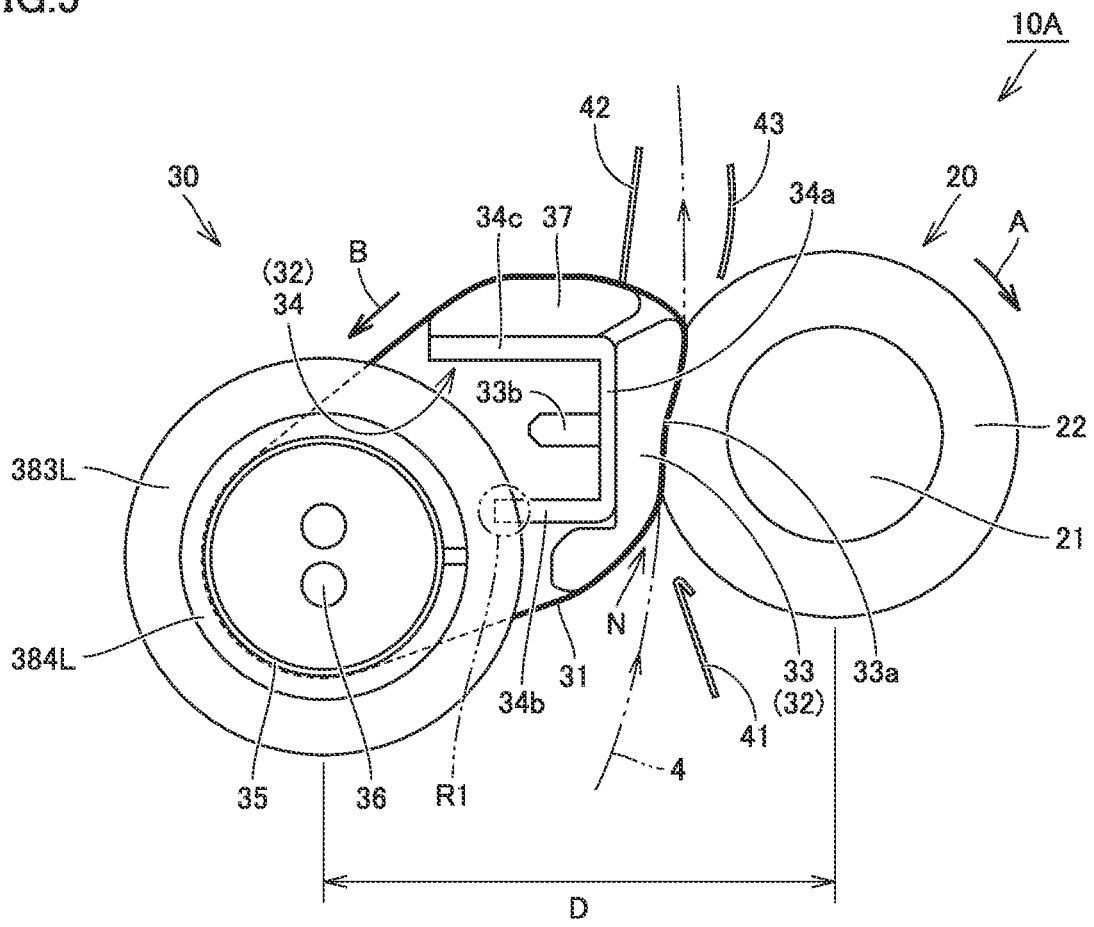
FIG. 5 is a schematic side view illustrating a fixing device according to a first configuration example.
Figure 6:
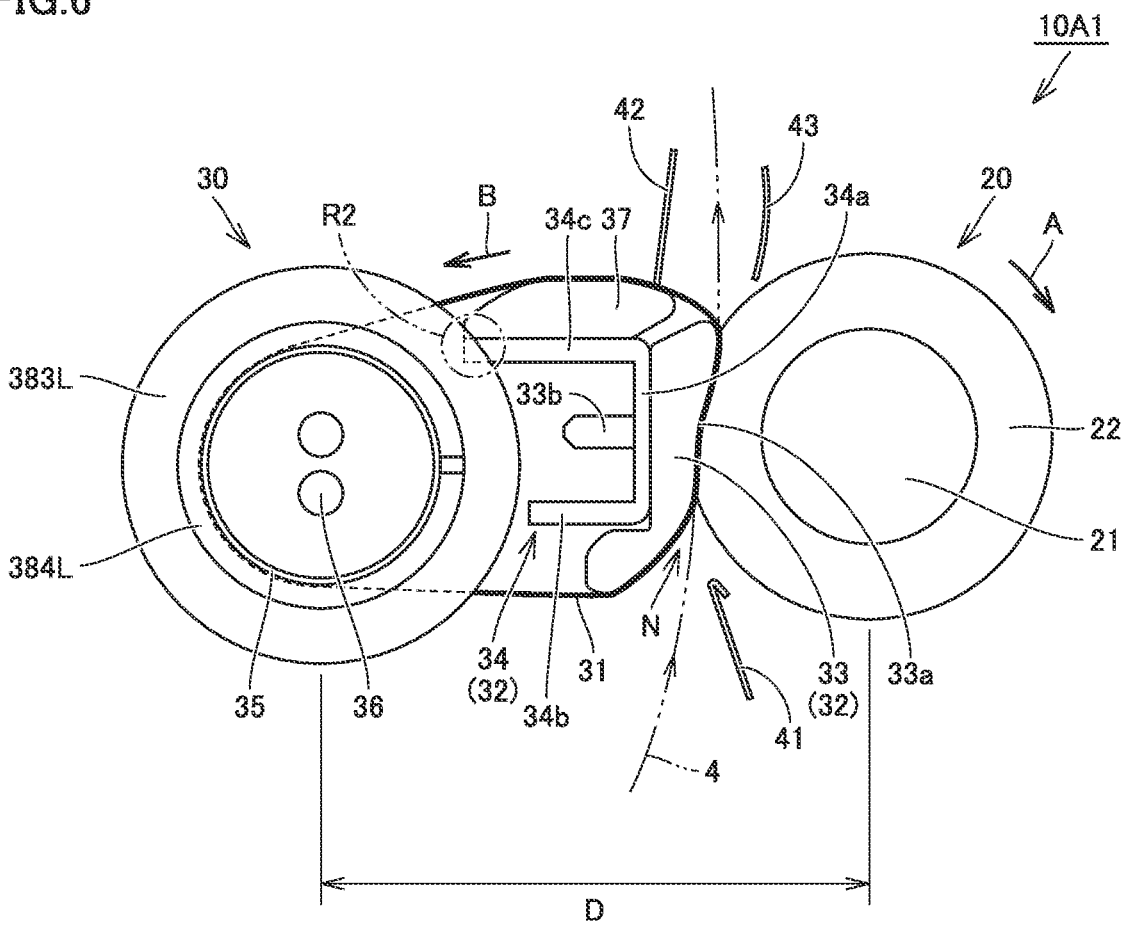
FIG. 6 is a schematic side view illustrating a fixing device according to a second configuration example.
Figure 7:
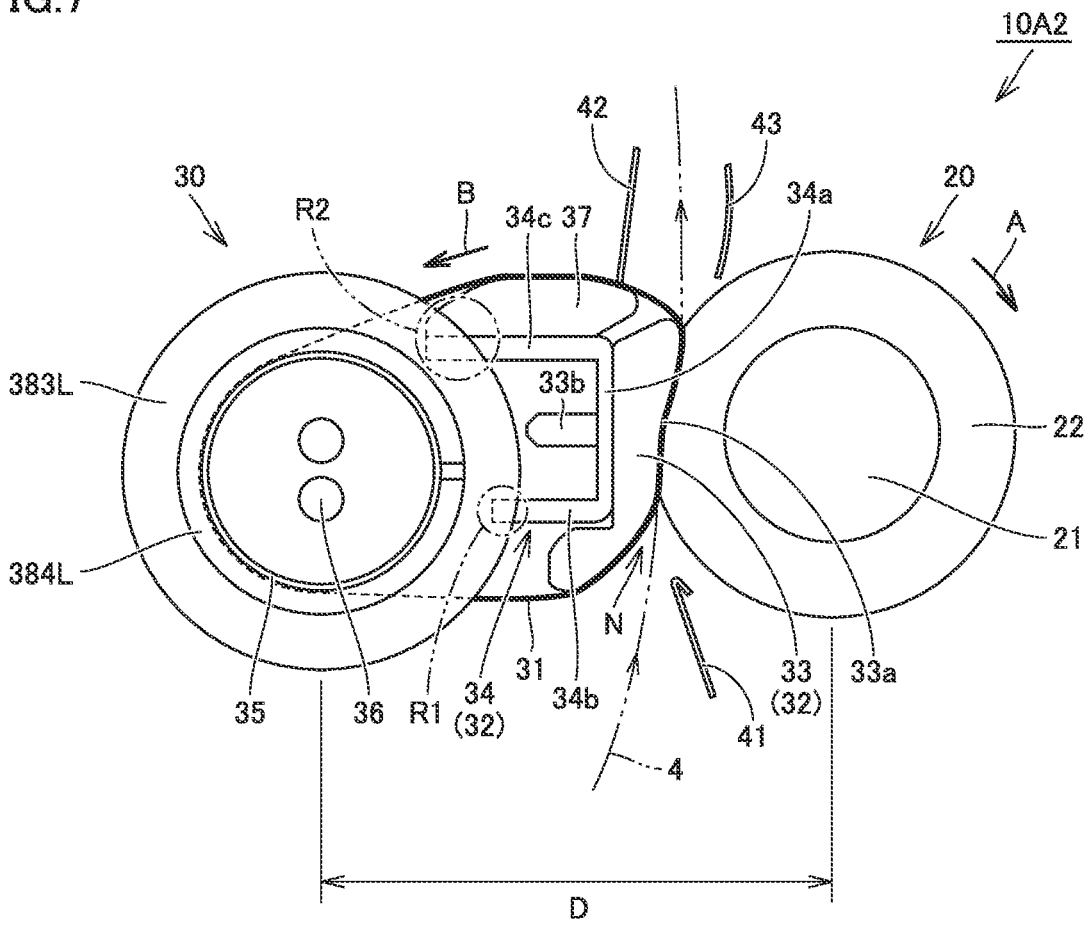
FIG. 7 is a schematic side view illustrating a fixing device according to a third configuration example.

FIGS. 5 to 7 are schematic side views illustrating a fixing device according to first to third configuration examples. As in the first embodiment, three types of layouts of the first to third configuration examples in FIGS. 5 to 7 are roughly assumed as the specific layout in the case where pad unit 32 and heating roller 35 are disposed close to each other while the pair of first supports SP1L, SP1R supporting pad unit 32 and the pair of second supports SP2L, SP2R journaling heating roller 35 are provided at different positions in the width direction of fixing belt 31. Each layout will be described below.

At this point, the first configuration example in FIG. 5 represents the layout of fixing device 10A itself of the first embodiment in FIGS. 2 to 4, and the side view in FIG. 5 is a side view as viewed from a direction indicated by an arrow V in FIG. 3. Each of the second and third configuration examples in FIGS. 6 and 7 is one in which the installation position of heating roller 35 is appropriately changed in the first configuration example, and each of the side views in FIGS. 6 and 7 is a side view as viewed from the same direction as the side view in FIG. 5. For the purpose of easy understanding, first plate-shaped chassis 38L is omitted in FIGS. 5 to 7.

As illustrated in FIG. 5, in fixing device 10A of the first configuration example, when viewed along the width direction of fixing belt 31, heating roller 35 is disposed close to pad unit 32 such that a part of bearing 383L assembled in the left end of heating roller 35 overlaps the rear end (that is, the end of upstream-side standing wall 34*b* on the side opposite to the base 34*a* side) of upstream-side standing wall 34*b* provided on reinforcing member 34 of pad unit 32 (see a region R1 in FIG. 5). In this case, although not illustrated in FIG. 5, apart of bearing 383R assembled in the right end of heating roller 35 also overlaps the rear end of upstream-side standing wall 34*b* provided on reinforcing member 34 of pad unit 32 when viewed along the width direction of fixing belt 31.

With this configuration, a distance D between the rotating axis of heating roller 35 in which bearings 383L, 383R are assembled and the rotating axis of pressure roller 20 can be shortened in a direction substantially orthogonal to the conveyance direction of sheet S. For this reason, the outer diameter in the direction of fixing device 10A can be decreased, and the circumferential length of fixing belt 31 can be shortened.

As illustrated in FIG. 6, in a fixing device 10A1 of the second configuration example, when viewed along the width direction of fixing belt 31, heating roller 35 is disposed close to pad unit 32 such that a part of bearing 383L assembled in the left end of heating roller 35 overlaps the rear end (that is, the end of downstream-side standing wall 34*c* on the side opposite to the base 34*a* side) of downstream-side standing wall 34*c* provided on reinforcing member 34 of pad unit 32 (see a region R2 in FIG. 6). In this case, although not illustrated in FIG. 6, a part of bearing 383R assembled in the right end of heating roller 35 also overlaps the rear end of downstream-side standing wall 34*c* provided on reinforcing member 34 of pad unit 32 when viewed along the width direction of fixing belt 31.

With this configuration, a distance D between the rotating axis of heating roller 35 in which bearings 383L, 383R are assembled and the rotating axis of pressure roller 20 can be shortened in a direction substantially orthogonal to the conveyance direction of sheet S. For this reason, the outer diameter in the direction of fixing device 10A1 can be decreased, and the circumferential length of fixing belt 31 can be shortened.

As illustrated in FIG. 7, in a fixing device 10A2 of the third configuration example, when viewed along the width direction of fixing belt 31, heating roller 35 is disposed close to pad unit 32 such that a part of bearing 383L assembled in the left end of heating roller 35 overlaps the rear ends of upstream-side standing wall 34*b* and downstream-side standing wall 34*c* provided on reinforcing member 34 of pad unit 32 (see regions R1, R2 in FIG. 7). In this case, although not illustrated in FIG. 7, a part of the bearing 383R assembled in the right end of heating roller 35 also overlaps the rear ends of upstream-side standing wall 34*b* and downstream-side standing wall 34*c* provided on reinforcing member 34 of pad unit 32 when viewed along the width direction of fixing belt 31.

With this configuration, a distance D between the rotating axis of heating roller 35 in which bearings 383L, 383R are assembled and the rotating axis of pressure roller 20 can be shortened in a direction substantially orthogonal to the conveyance direction of sheet S. For this reason, the outer diameter in the direction of fixing device 10A2 can be decreased, and the circumferential length of fixing belt 31 can be shortened.

Second Embodiment

Figure 8:
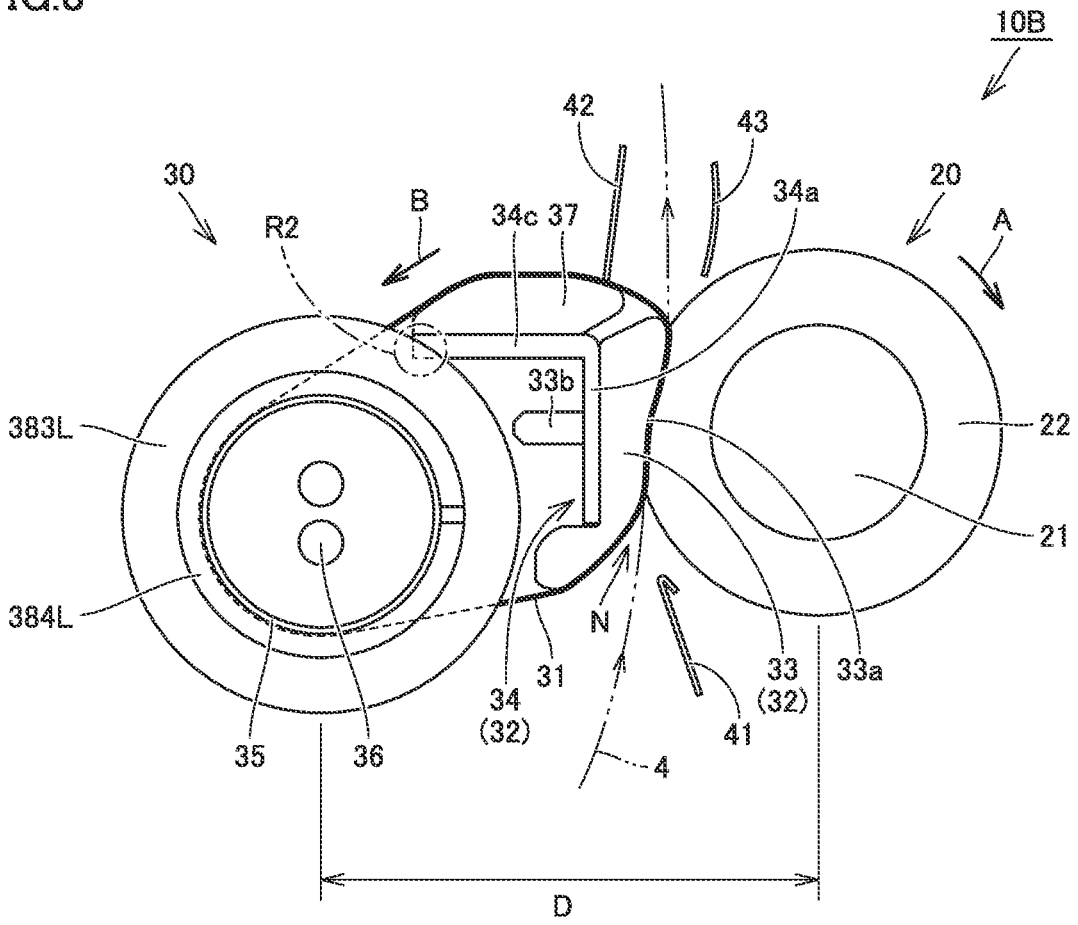
FIG. 8 is a schematic side view illustrating a fixing device according to a second embodiment.

FIG. 8 is a schematic side view illustrating a fixing device according to a second embodiment. A fixing device 10B of the second embodiment will be described below with reference to FIG. 8. For the purpose of easy understanding, first plate-shaped chassis 38L is omitted in FIG. 8.

Instead of fixing device 10A of the first embodiment, fixing device 10B of the second embodiment is included in image forming apparatus 1. As illustrated in FIG. 8, fixing device 10B of the second embodiment is different from fixing device 10A of the first embodiment in the configuration of reinforcing member 34 of pad unit 32.

Specifically, reinforcing member 34 of fixing device 10B of the second embodiment has an approximately L-shaped section including flat plate-shaped base 34*a* opposed to pad body 33 and downstream-side standing wall 34*c* provided upright from base 34*a* at the downstream position in the conveyance direction of sheet S, but reinforcing member 34 does not include upstream-side standing wall 34*b* (see FIGS. 2 and 5) included in reinforcing member 34 of fixing device 10A of the first embodiment.

At this point, even in fixing device 10B of the second embodiment, similarly to fixing device 10A of the first embodiment, the pair of first supports SP1L, SP1R supporting pad unit 32 and the pair of second supports SP2L, SP2R journaling heating roller 35 are provided at different positions in the width direction of fixing belt 31 (see FIGS. 3 and 4).

Further, in fixing device 10B of the second embodiment, when viewed along the width direction of fixing belt 31, heating roller 35 is disposed close to pad unit 32 such that a part of bearing 383L assembled in the left end of heating roller 35 overlaps the rear end of downstream-side standing wall 34*c* provided on reinforcing member 34 of pad unit 32 (seethe region R2 in FIG. 8). Although not illustrated in FIG. 8, apart of bearing 383R attached to the right end of heating roller 35 also overlaps the rear end of downstream-side standing wall 34*c* provided on reinforcing member 34 of pad unit 32 when viewed along the width direction of fixing belt 31.

Even in this configuration, similarly to the case of the first embodiment, distance D between the rotating axis of heating roller 35 in which bearings 383L, 383R are assembled and the rotating axis of pressure roller 20 can be shortened in the direction substantially orthogonal to the conveyance direction of sheet S. For this reason, the outer diameter in the direction of fixing device 10B can be decreased, and the circumferential length of fixing belt 31 can be shortened.

Thus, even when the configuration of the second embodiment is adopted, similarly to the first embodiment, fixing device 10B in which the energy saving is achieved while the downsizing is further performed than before and image forming apparatus 1 including fixing device 10B can be constructed.

SUMMARY OF CONTENTS DISCLOSED IN THE EMBODIMENTS

The contents disclosed in the first and second embodiments are summarized as follows.

A fixing device fixes a toner image formed on a recording material to the recording material, and includes a fixing belt, a heat source, a pad unit, a pressure rotating body, a driven roller, a pair of first support, and a pair of second supports. The fixing belt is an endless fixing belt, and the heat source is configured to heat the fixing belt. The pad unit is disposed so as to be opposed to an inner peripheral surface of the fixing belt, and the pressure rotating body is disposed so as to be opposed to an outer peripheral surface of the fixing belt. The pressure rotating body is rotated while the fixing belt is pressed against the pad unit, so that the pressure rotating body forms a nip in which the recording material is conveyed between the outer peripheral surface of the fixing belt and the pressure rotating body while driving the fixing belt to rotate. The driven roller is disposed so as to be opposed to the inner peripheral surface of the fixing belt, so that the fixing belt is entrained around the driven roller and the pad unit, the driven roller being driven to rotate in association with rotation of the fixing belt. The pair of first supports is located so as to sandwich the fixing belt in a width direction of the fixing belt, the pair of first supports supporting the pad unit by fixing the pad unit. The pair of second supports is located so as to sandwich the pair of first supports in the width direction of the fixing belt, the pair of second supports rotatably journaling the driven roller.

In the fixing device, each of the pair of second supports may include a bearing. In this case, at least a part of the bearing preferably overlaps at least a part of the pad unit when viewed along the width direction of the fixing belt.

In the fixing device, the pad unit may include: a pad body including an opposing surface opposed to the inner peripheral surface of the fixing belt; and a reinforcing member disposed on a side opposite to a side where the opposing surface is located as viewed from the pad unit, the reinforcing member reinforcing the pad body by supporting the pad unit. In this case, at least a part of the bearing preferably overlaps at least a part of the reinforcing member when viewed along the width direction of the fixing belt.

In the fixing device, the reinforcing member may have a substantially C-shaped section including a flat plate-shaped base opposed to the pad body, a flat plate-shaped upstream-side standing wall provided upright from the base toward the side opposite to the side where the pad body is located at an upstream position in a conveyance direction of the recording material, and a flat plate-shaped downstream-side standing wall provided upright from the base toward the side opposite to the side where the pad body is located at a downstream position in the conveyance direction of the recording material. In this case, at least a part of the bearing preferably overlaps at least a part of at least one of the upstream-side standing wall and the downstream-side standing wall when viewed along the width direction of the fixing belt.

In the fixing device, the reinforcing member may have a substantially L-shaped section including a flat plate-shaped base opposed to the pad body and a flat plate-shaped downstream-side standing wall provided upright from the base toward the side opposite to the side where the pad body is located at a downstream position in a conveyance direction of the recording material. In this case, at least a part of the bearing preferably overlaps at least a part of the downstream-side standing wall when viewed along the width direction of the fixing belt.

The fixing device may include a first plate-shaped chassis having a bent shape provided on one side in the width direction of the fixing belt and a second plate-shaped chassis having a bent shape provided on the other side in the width direction of the fixing belt. In this case, the first plate-shaped chassis may include a pair of first walls opposed to each other in the width direction of the fixing belt, and the second plate-shaped chassis may include a pair of second walls opposed to each other in the width direction of the fixing belt. In this case, preferably, in the pair of first supports, the first support located on the one side in the width direction of the fixing belt is provided on one of the pair of first walls, in the pair of second supports, the second support located on the one side in the width direction of the fixing belt is provided on the other of the pair of first walls, in the pair of first supports, the first support located on the other side in the width direction of the fixing belt is provided on one of the pair of second walls, and in the pair of second supports, the second support located on the other side in the width direction of the fixing belt is provided on the other of the pair of second walls.

An image forming apparatus includes the fixing device in order to form an image.

(Other Forms)

In the first and second embodiments, by way of example, a part of the bearing assembled in the heating roller as the driven roller overlaps a part of the reinforcing member of the pad unit when viewed along the width direction of the fixing belt. Alternatively, a part of the bearing overlaps a part of the pad body of the pad unit in addition to or instead of the reinforcing member.

The bearing does not necessarily overlap the pad unit when viewed along the width direction of the fixing belt. Even in such cases, when the pair of first supports supporting the pad unit and the pair of second supports journaling the heating roller are provided at different positions in the width direction of the fixing belt, this contributes to the downsizing of the fixing device.

In the first and second embodiments, by way of example, one of the pair of first supports supporting the pad unit and one of the pair of second supports journaling the heating roller as the driven roller are provided in the first plate-shaped chassis having the bent shape, and the other of the pair of first supports supporting the pad unit and the other of the pair of second supports journaling the heating roller are provided in the second plate-shaped chassis having the bent shape. However, the present disclosure does not necessarily have the configuration.

For example, one of the pair of first supports supporting the pad unit and one of the pair of second supports journaling the heating roller may be provided in different chassis, and the other of the first supports supporting the pad unit and the other of the pair of second supports journaling the heating roller may be provided in different chassis.

In the first and second embodiments, by way of example, the present invention is applied to what is called a tandem-type color printer in which the electrophotographic system is adopted and the fixing device included in the tandem-type color printer. However, the application of the present invention is not limited to this configuration, and the present invention can be applied to various image forming apparatuses in which the electrophotographic system is adopted and fixing devices included in the image forming apparatuses.

Although embodiments of the present invention have been described and illustrated in detail, the disclosed embodiments are made for purposes of illustration and example only and not limitation. The scope of the present invention should be interpreted by terms of the appended claims.

What is claimed is:

1. A fixing device that fixes a toner image formed on a recording material onto the recording material, the fixing device comprising:

an endless fixing belt;

a heat source configured to heat the fixing belt;

a pad unit disposed so as to be opposed to an inner peripheral surface of the fixing belt;

a pressure rotating body disposed so as to be opposed to an outer peripheral surface of the fixing belt, the pressure rotating body being rotated while the fixing belt is pressed against the pad unit, so that the pressure rotating body forms a nip in which the recording material is conveyed between the outer peripheral surface of the fixing belt and the pressure rotating body while driving the fixing belt to rotate;

a driven roller disposed so as to be opposed to the inner peripheral surface of the fixing belt, so that the fixing belt is entrained around the driven roller and the pad unit, the driven roller being driven to rotate in association with rotation of the fixing belt;

a pair of first supports such that the fixing belt in a width direction of the fixing belt is disposed between the pair of first supports, the pair of first supports supporting the pad unit by fixing the pad unit in a stationary position; and a pair of second supports such that the pair of first supports in the width direction of the fixing belt are disposed between the pair of second supports, the pair of second supports rotatably journaling the driven roller;

a bush encircling each end of the driven roller, each of the pair of second supports includes a bearing, the bearing of each of the pair of second supports encircling a respective bush of the driven roller, and at least a part of each of the bearings overlaps at least a part of the pad unit when viewed along the width direction of the fixing belt.

2. The fixing device according to claim 1, wherein the pad unit includes: a pad body including an opposing surface opposed to the inner peripheral surface of the fixing belt; and a reinforcing member disposed on a side opposite to a side where the opposing surface is located as viewed from the pad unit, the reinforcing member reinforcing the pad body by supporting the pad unit, and at least a part of the bearing overlaps at least a part of the reinforcing member when viewed along the width direction of the fixing belt.

3. The fixing device according to claim 2, wherein the reinforcing member has a substantially C-shaped section including a flat plate-shaped base opposed to the pad body, a flat plate-shaped upstream-side standing wall provided upright from the base toward the side opposite to the side where the pad body is located at an upstream position in a conveyance direction of the recording material, and a flat plate-shaped downstream-side standing wall provided upright from the base toward the side opposite to the side where the pad body is located at a downstream position in the conveyance direction of the recording material, and at least a part of the bearing overlaps at least a part of at least one of the upstream-side standing wall and the downstream-side standing wall when viewed along the width direction of the fixing belt.

4. The fixing device according to claim 2, wherein the reinforcing member has a substantially L-shaped section including a flat plate-shaped base opposed to the pad body and a flat plate-shaped downstream-side standing wall provided upright from the base toward the side opposite to the side where the pad body is located at a downstream position in a conveyance direction of the recording material, and at least a part of the bearing overlaps at least a part of the downstream-side standing wall when viewed along the width direction of the fixing belt.

5. The fixing device according to claim 1, further comprising:

a first plate-shaped chassis having a bent shape provided on one side in the width direction of the fixing belt; and a second plate-shaped chassis having a bent shape provided on the other side in the width direction of the fixing belt, wherein the first plate-shaped chassis includes a pair of first walls opposed to each other in the width direction of the fixing belt, the second plate-shaped chassis includes a pair of second walls opposed to each other in the width direction of the fixing belt, in the pair of first supports, the first support located on the one side in the width direction of the fixing belt is provided on one of the pair of first walls, in the pair of second supports, the second support located on the one side in the width direction of the fixing belt is provided on the other of the pair of first walls, in the pair of first supports, the first support located on the other side in the width direction of the fixing belt is provided on one of the pair of second walls, and in the pair of second supports, the second support located on the other side in the width direction of the fixing belt is provided on the other of the pair of second walls.

6. An image forming apparatus comprising the fixing device according to claim 1 in order to form an image.

* * * * *